US007360839B1

(12) United States Patent
Chen

(10) Patent No.: US 7,360,839 B1
(45) Date of Patent: Apr. 22, 2008

(54) APPARATUS FOR ADJUSTING AN ARMREST OF AN OFFICE CHAIR

(76) Inventor: Yung-Hua Chen, 1F, No. 2, Lane 157, Wan-an Street, Sinjhuang City, Taipei County 242 (TW)

( * ) Notice: Subject to any disclaimer, the term of this patent is extended or adjusted under 35 U.S.C. 154(b) by 0 days.

(21) Appl. No.: 11/783,905

(22) Filed: Apr. 13, 2007

(51) Int. Cl.
*A47C 7/54* (2006.01)

(52) U.S. Cl. ..... 297/411.2; 297/411.36; 297/411.37; 297/411.38

(58) Field of Classification Search ..... 297/411.2, 297/411.36, 411.37, 411.38, 353, 410
See application file for complete search history.

(56) References Cited

U.S. PATENT DOCUMENTS 5,318,347 A * 6/1994 Tseng ..... 297/411.36
5,368,365 A * 11/1994 Feldberg ..... 297/411.36
5,382,079 A * 1/1995 Wilson et al. ..... 297/411.36
6,062,647 A * 5/2000 Mei ..... 297/411.36
6,398,309 B1 * 6/2002 Chen ..... 297/411.36
6,896,333 B1 * 5/2005 Matern et al. ..... 297/411.36
7,097,254 B2 * 8/2006 Hobb et al. ..... 297/411.36
7,159,947 B1 * 1/2007 Lee ..... 297/411.37
7,201,449 B2 * 4/2007 Tsai ..... 297/411.36

* cited by examiner

*Primary Examiner*—Laurie K. Cranmer
(74) *Attorney, Agent, or Firm*—Rosenberg, Klein & Lee

(57) ABSTRACT

An angle-adjusting apparatus for an office chair includes: a supporting body with an bottom end attached to one side of a seat body of the office chair, a receiving cavity being defined by the front side of the upper portion of the supporting body, a plurality of notches being continuously formed in the front wall of the supporting body; a hollow socket mounted on the supporting body and liftable thereon; a locking shank having a pivot pin disposed at the top thereof and a protrusion at the bottom thereof for fitting into one of the notches, a spring being interposed between the front side of the locking shank and the wall of the hollow socket for providing the locking shank with an elastic pushing force in direction of the notches, a holding portion passing through the through hole of the hollow socket being extended forward from the pivot pin of the locking shank; and an armrest body transversely disposed at the top of the hollow socket and movably connected to the hollow socket so as to perform the ascending and descending action thereof.

3 Claims, 8 Drawing Sheets

APPARATUS FOR ADJUSTING AN ARMREST OF AN OFFICE CHAIR

BACKGROUND OF THE INVENTION

1. Field of the Invention

The present invention relates to an office chair, and more particularly to a height-adjustable armrest structure.

2. Description of the Related Art

Referring to FIG. 1 that is a perspective view of a conventional office chair 10, a supporting portion 11 and an armrest portion 12 are disposed at both sides thereof, thereby forming an armrest assembly 13. In this way, both hands of the user can be placed on the armrest portions 12 for obtaining a comfortable sitting feeling. The conventional supporting portions 11 and the armrest portions 12 are integrally made of plastic by an injection molding process. Alternatively, the supporting portions 11 are made of metal whereupon the armrest portions 12 made of plastic are mounted on the supporting portions 11, thereby creating a fixed type structure that permits neither the height adjustment nor the angular adjustment. Thus, the individual requirements of the user are not fulfilled.

U.S. Pat. No. 6,062,646 disclosed an adjustable-height armrest in which the locking bolts are disposed at the center of the armrest carrier. This arrangement makes the height adjustment more difficult. In other words, an ergonomic operation interface is required for a convenient use. Furthermore, U.S. Pat. No. 6,948,775 discloses an office chair armrest that permits the angular adjustment as well as the forward and backward movement of the armrests. However, this structure does not achieve a height adjustment. It is important to provide the function of the height adjustment. The angular adjustment as well as the forward and backward movement of the armrests may have their substantial effects only when the function of the height adjustment is available. In other words, the angular adjustment as well as the forward and backward movement of the armrests won't provide the user with the optimal sitting feeling when the armrests are too high or too low.

SUMMARY OF THE INVENTION

It is a primary object of the invention to provide an apparatus for adjusting an armrest of an office chair in which the adjusting and holding portion of the locking shank is positioned just at the bottom end of the armrest where the arm leans on the top of the armrest and the finger has an easy access to the locking shank for achieving a practical adjustment and meeting the ergonomic requirements.

It is another object of the present invention to provide an apparatus for adjusting an armrest of an office chair that ensures an adjustment of the angle and the front and rear position of the armrest after its height adjustment. Accordingly, a three-dimensional adjustment of the armrest is achieved.

In order to achieve the above-mentioned objects, an angle-adjusting apparatus for an office chair includes:

a) a supporting body with an bottom end attached to one side of a seat body of the office chair, a receiving cavity being defined by the front side of the upper portion of the supporting body, a plurality of notches being continuously formed in the front wall of the supporting body;

b) a hollow socket mounted on the supporting body and liftable thereon;

c) a locking shank having a pivot pin disposed at the top thereof and a protrusion at the bottom thereof for fitting into one of the notches, a spring being interposed between the front side of the locking shank and the wall of the hollow socket for providing the locking shank with an elastic pushing force in direction of the notches, a holding portion passing through the through hole of the hollow socket being extended forward from the pivot pin of the locking shank; and d) an armrest body transversely disposed at the top of the hollow socket and movably connected to the hollow socket so as to perform the ascending and descending action thereof.

BRIEF DESCRIPTION OF THE FIGURES

The accomplishment of this and other objects of the invention will become apparent from the following descriptions and its accompanying figures of which.

DETAILED DESCRIPTION OF THE PREFERRED EMBODIMENT

Figure 1:
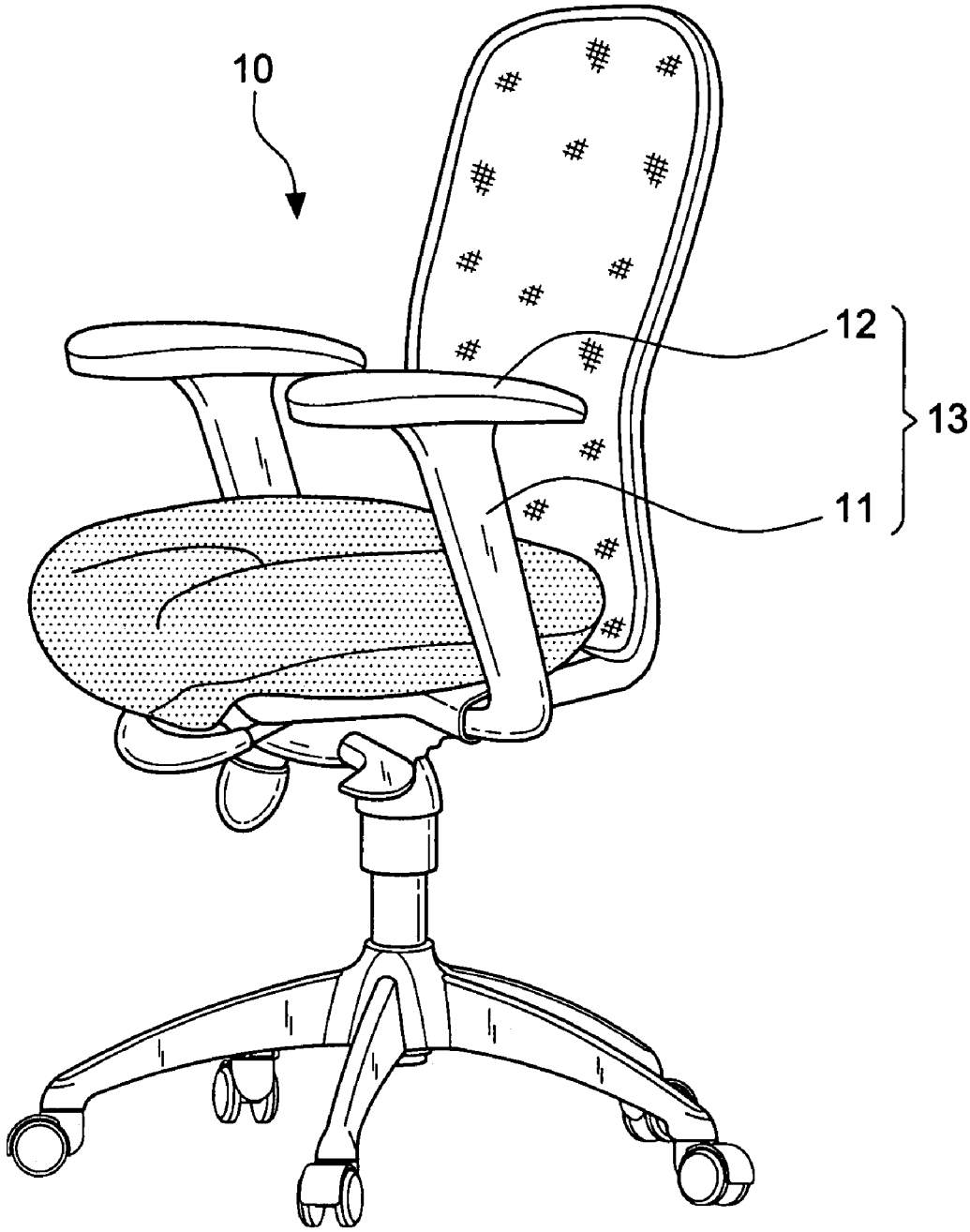
FIG.1 (PRIOR ART)
FIG. 1 is a perspective view of a conventional office chair.
Figure 2:
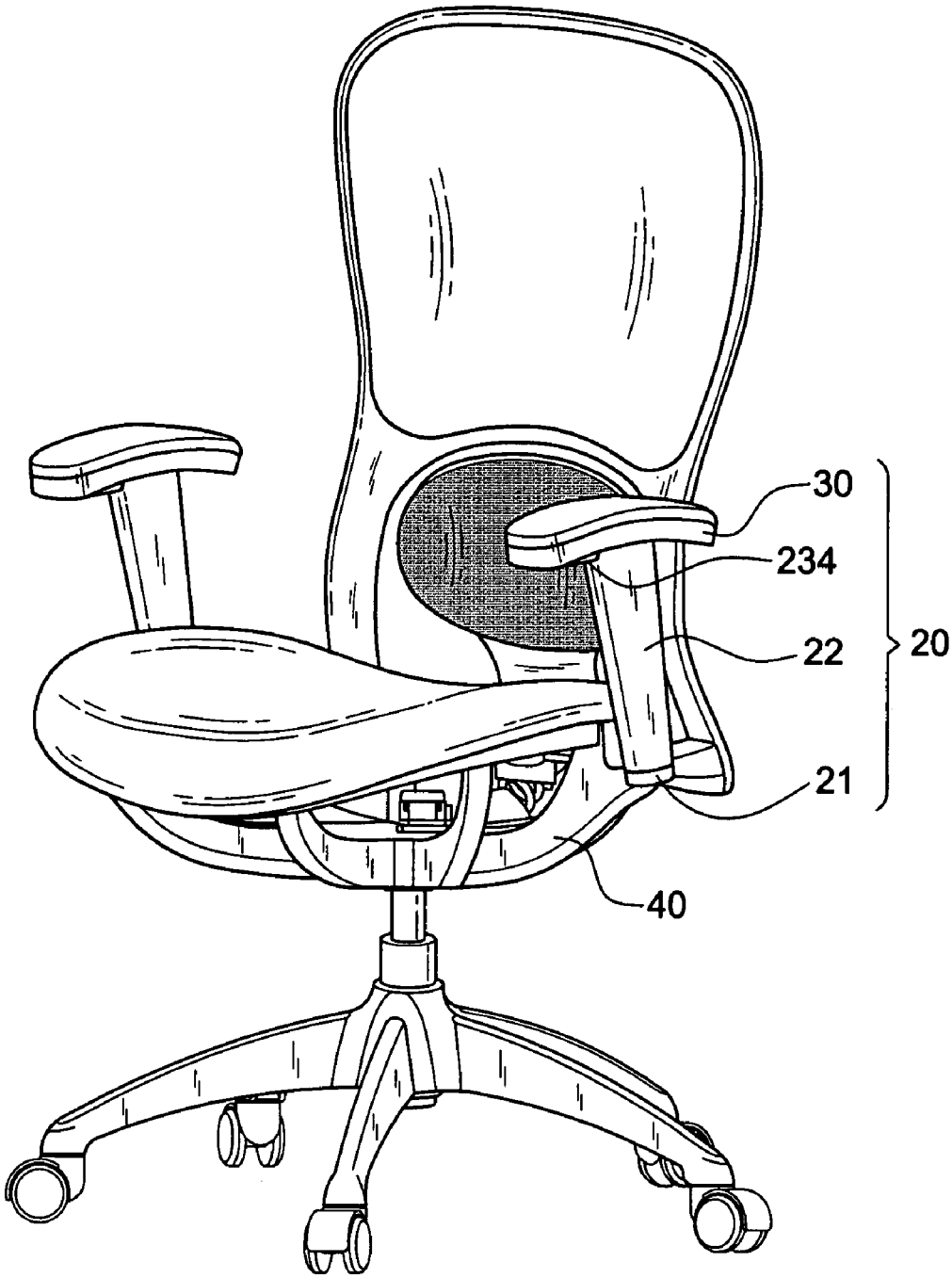
FIG. 2 is a perspective view of the invention.
Figure 3:
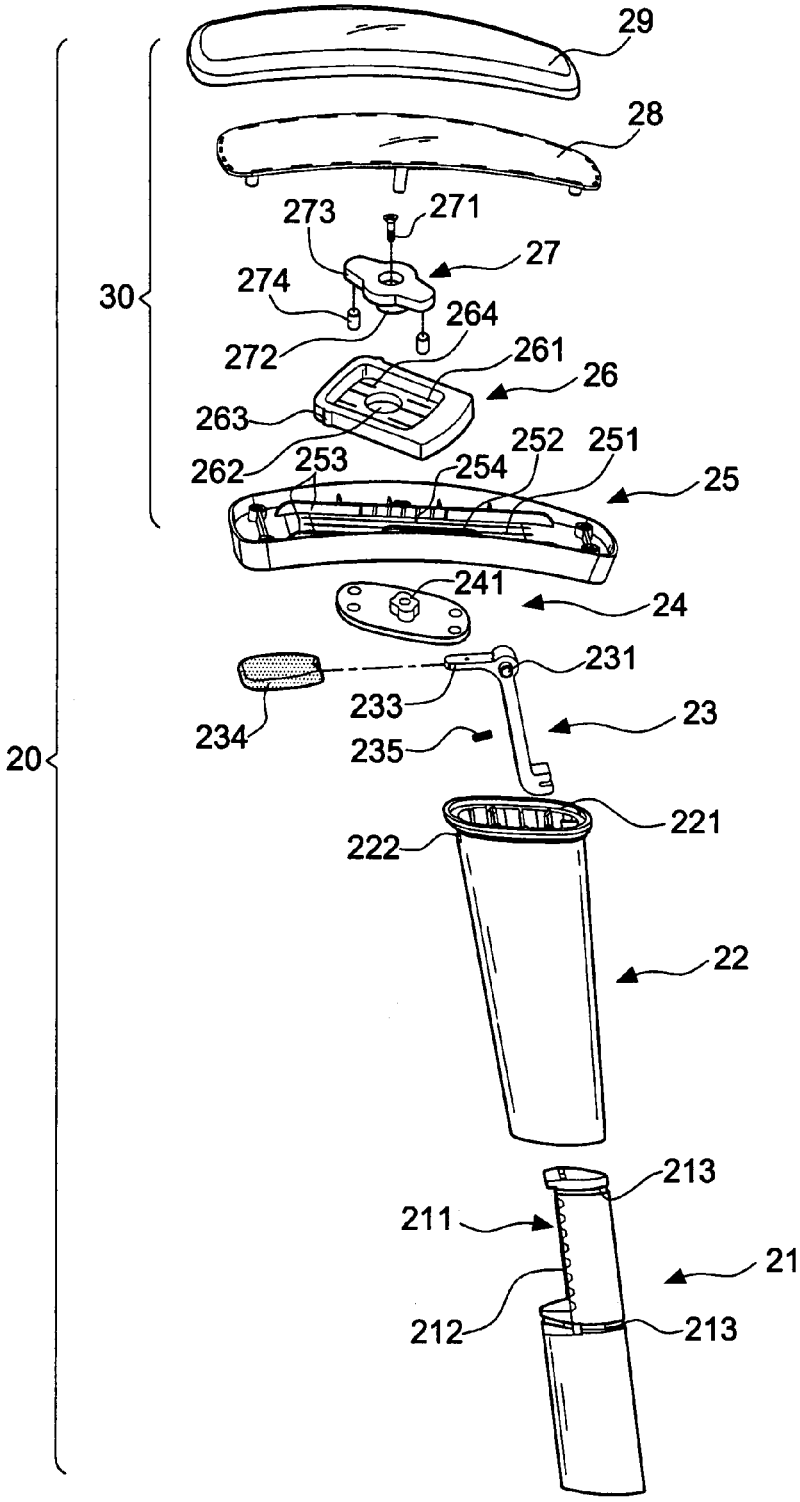
FIG. 3 is a perspective exploded view of the invention.
Figure 4:
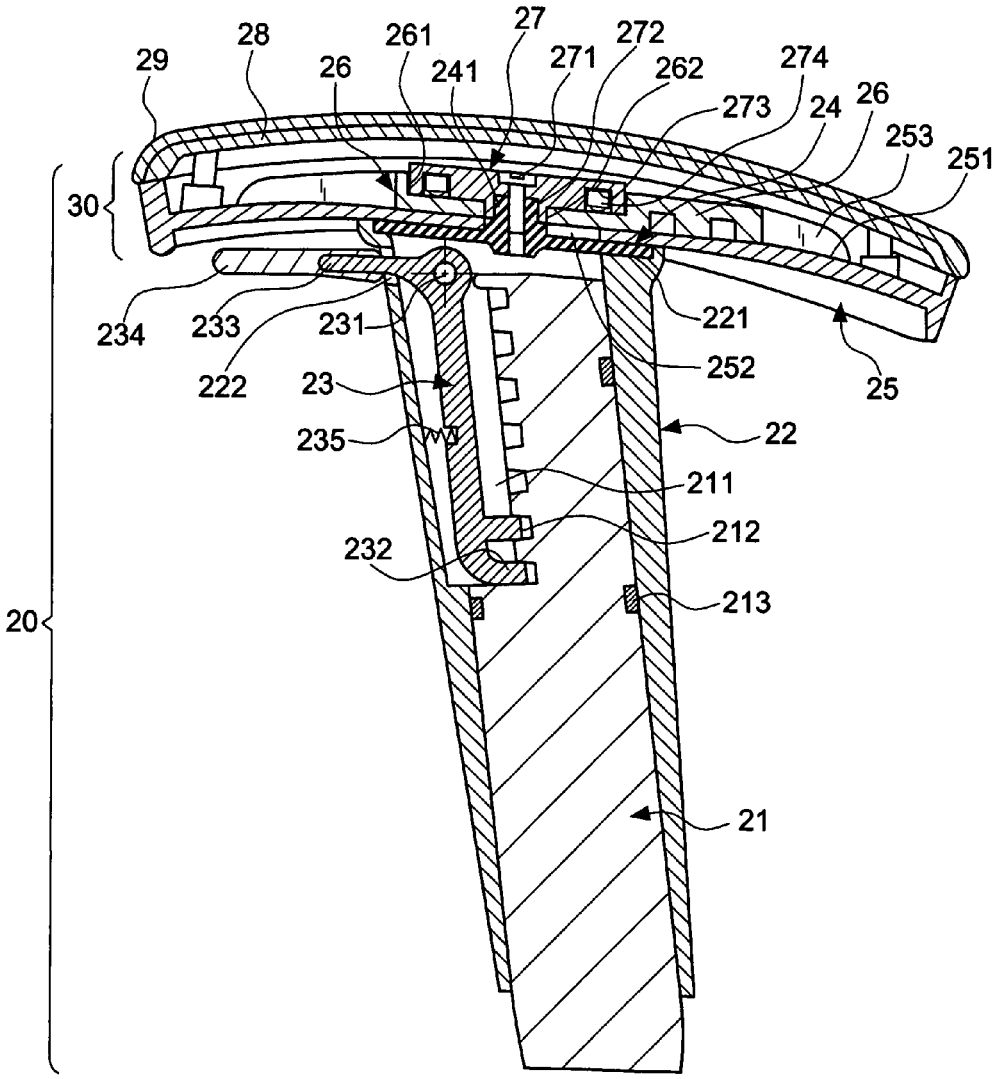
FIG. 4 is a cutaway view of the invention.

First of all, referring to FIGS. 2 through 4, an armrest assembly 20 in accordance with the invention includes a supporting body 21, a hollow socket 22, a locking shank 23, a retaining plate 24, and an armrest body 30.

The supporting body 21 is longitudinally extended with a bottom end attached to one side of a seat body 40 of an office chair. A receiving cavity 211 is defined by the front side of the upper portion of the supporting body 21. A plurality of notches 212 are continuously arranged and vertically formed in the front wall of the supporting body 21.

The hollow socket 22 is mounted on the supporting body 21 and liftable thereon. A flange 221 is formed at the rim of an upward directed opening of the hollow socket 22. A through hole 222 is directed forward and formed at the bottom of the flange 221.

The locking shank 23 includes a pivot pin 231 disposed at the top thereof and pivotally received in the hollow socket 22 at a location corresponding to the receiving cavity 211 of the supporting body 21 as well as a protrusion 232 at the bottom thereof for fitting into one of the notches 212. A spring 235 is interposed between the front side of the locking shank 23 and the wall of the hollow socket 22 for providing the locking shank 23 with an elastic pushing force in direction of the notches 212. A holding portion 233 passing through the through hole 222 of the hollow socket 22 is extended forward from the pivot pin 231 of the locking shank 23.

The retaining plate 24 is locked on the flange 221 of the hollow socket 22. A positioning portion 241 is positioned at the center of the retaining plate 24.

The armrest body 30 is transversely disposed at the top of the hollow socket 22 and movably connected to the hollow socket 22 so as to perform the ascending and descending action thereof.

At least one C-shaped rubber ring 213 is retained within the groove in the outer rim of the supporting body 21 for enhancing the sealing effect on the internal wall of the hollow socket 22.

Moreover, a control lever 234 is sheathed on the holding portion 233 of the locking shank 23 for facilitating the finger action of controlling the locking shank 23 in locked or unlocked position.

Figure 5:
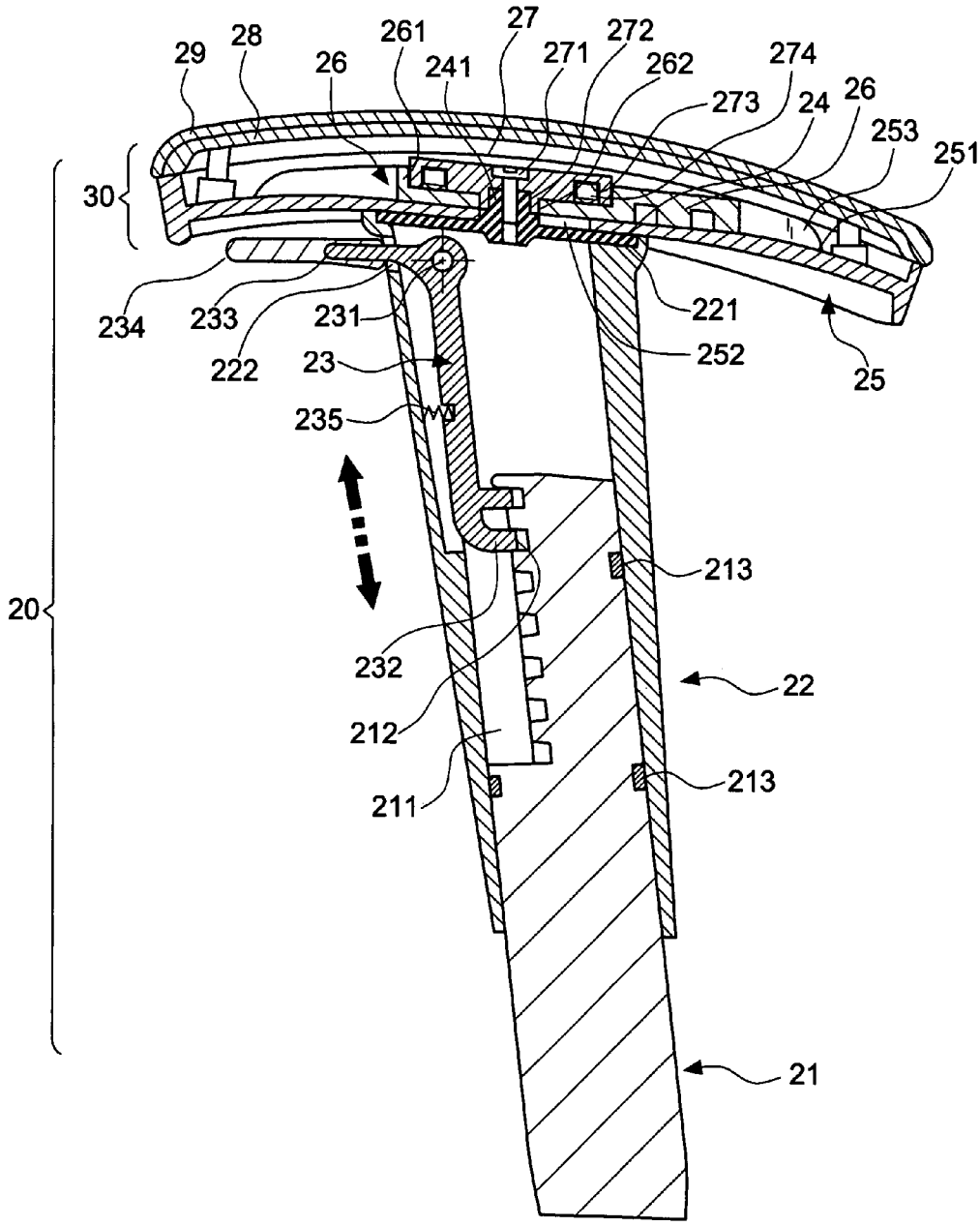
FIG. 5 is a cutaway view of the invention wherein the armrest body is lifted.
Figure 6:
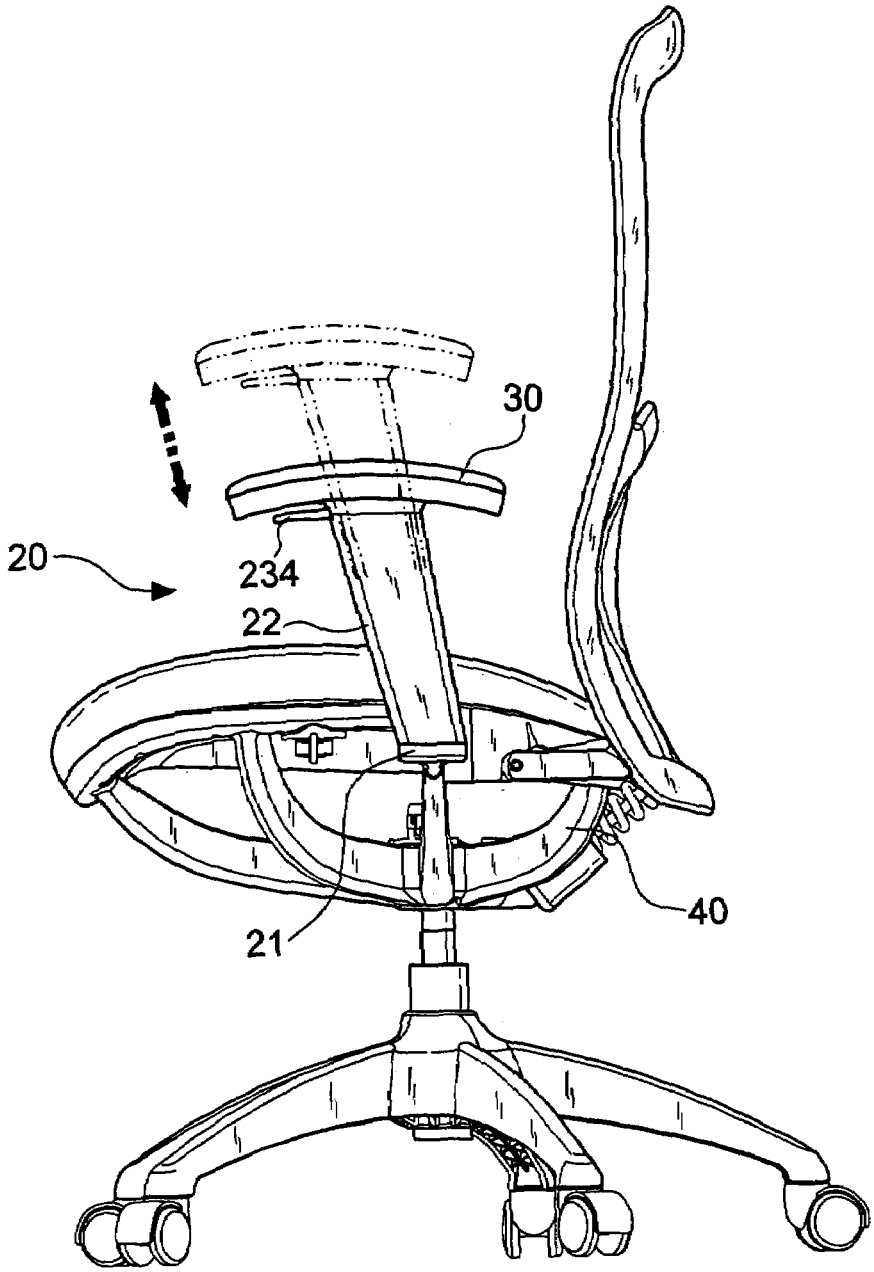
FIG. 6 is a side view of the operation of the invention.

Referring to FIGS. 5 and 6, a finger is used to hook up the control lever 234 when the user desires to adjust the lifting action of the armrest body 30. At that time, the locking shank 23 rotates on the pivot pin 231 such that the bottom end thereof is moved forward and the protrusion 232 is removed from the notch 212. In this way, the hollow socket 22 is liftable on the supporting body 21. When a desired height is reached, the control lever 234 can be released such that the locking shank 23 is brought inward by the spring 235. As a result, the protrusion 232 is engaged into another the notch 212 to retain the hollow socket 22 in place again.

Based upon the above-mentioned structure, the locking shank 23 within the hollow socket 22 is employed to adjust the height of the armrest body 30. Meanwhile, the holding portion 233 and the control lever 234 are installed just at a location of the bottom rim of the armrest body 30, thereby facilitating the adjustment of the height.

According to the above-mentioned height-adjusting structure, an armrest body 30 permitting the adjustment of angle and the forward and backward displacement includes a housing 25, a base 26, a compression piece 27, an upper cover 28, and a top portion 29.

The housing 25 includes a cavity formed in the top portion thereof. A bottom plate 251 has a transverse groove 252 at the center thereof for receiving the positioning portion 241 of the retaining plate 24. Two parallel clamping pieces 253 are disposed on the bottom plate 251 within the housing 25. A plurality of longitudinal ribs 254 are formed on opposite sides of the inner wall of the clamping pieces 253.

The base 26 is interposed between the two clamping pieces 253 of the housing 25. A groove 261 and a through hole 262 are formed at the top of the base 26. A plurality of transverse ribs 264 are provided on the top surface of the groove 261. An arched projection 263 is positioned at both external sides of the base 26 at a location corresponding to the longitudinal ribs 254 of the two clamping pieces 253.

The compression piece 27 is positioned within the groove 261 of the base 26. A connection portion 272 is formed at the center of the compression piece 27 and passes through the through hole 262 of the base 26 for mounting on the positioning portion 241 of the retaining plate 24. The compression piece 27 further includes a screw 271 for the positioning purpose. An engaging element 274 is respectively received in a notch 273 at the bottom of the front and rear ends of the compression piece 27 (see FIG. 7).

The upper cover 28 is retained at the top of the housing 25.

The top portion 29 is positioned on the surface of the upper cover 28. Based upon the above-mentioned configuration of the armrest assembly 20, the housing 25 may rotate to the left and right on the compression piece 27 at a certain angle for the purpose of adjustment. In other words, the compression piece 27 is retained at the top of the retaining plate 24 without locking the base 26 in place. In this way, the base 26 can be subject to a left and right angular adjustment with the housing 25. The upper cover 28 of the housing 25 and the top portion 29 are movable with the housing 25. When the housing 25 is subject to the angular adjustment, the front and rear engaging elements 274 within the notch 273 at the bottom rim of the compression piece 27 are employed to cooperate with the transverse ribs 264 on the surface of the groove 261 for engaging into each other. The engaging element 274 is an elastic engaging element. For example, the bottom rim includes steel ball head while the inside thereof has a spring-loaded compressing element. These are conventional elements so that no further descriptions thereto are given hereinafter.

Figure 7:
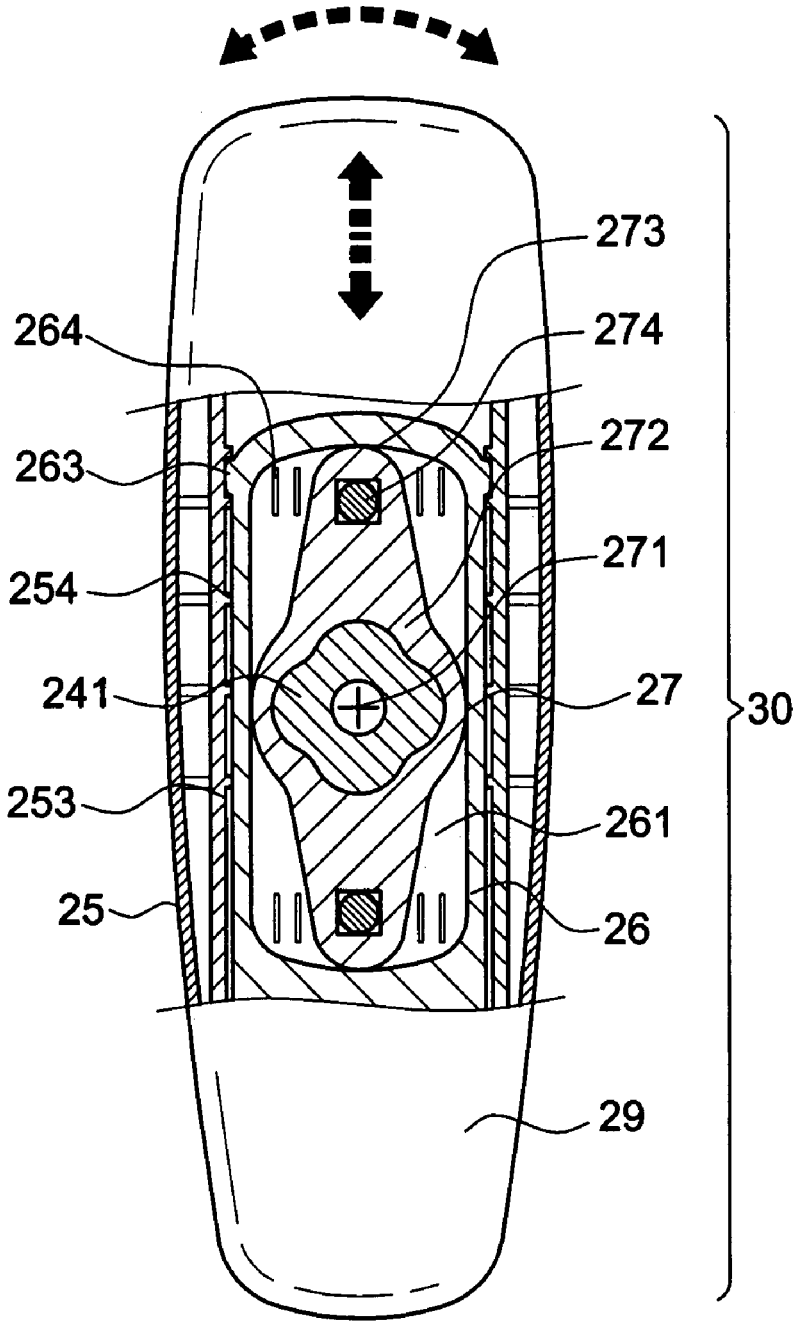
FIG. 7 is a half-sectional top view of the armrest of the invention.

Based upon the above-mentioned structure, the compression piece 27 is stationary while the base 26 is subject to a left and right angular adjustment without forward and backward movement. However, the housing 25 can be shifted forward and backward in addition to the rotation. The bottom plate 251 includes a transverse groove 252 such that a forward and backward movement thereof on the positioning portion 241 of the retaining plate 24 is achieved (see FIG. 5). As shown in FIG. 7, the longitudinal ribs 254 at the internal side of the clamping pieces 253 and the arched projection 263 at the external side of the base 26 are engaged into each other, thereby creating a positioning effect when the front and rear prearranged location is reached.

Figure 8:
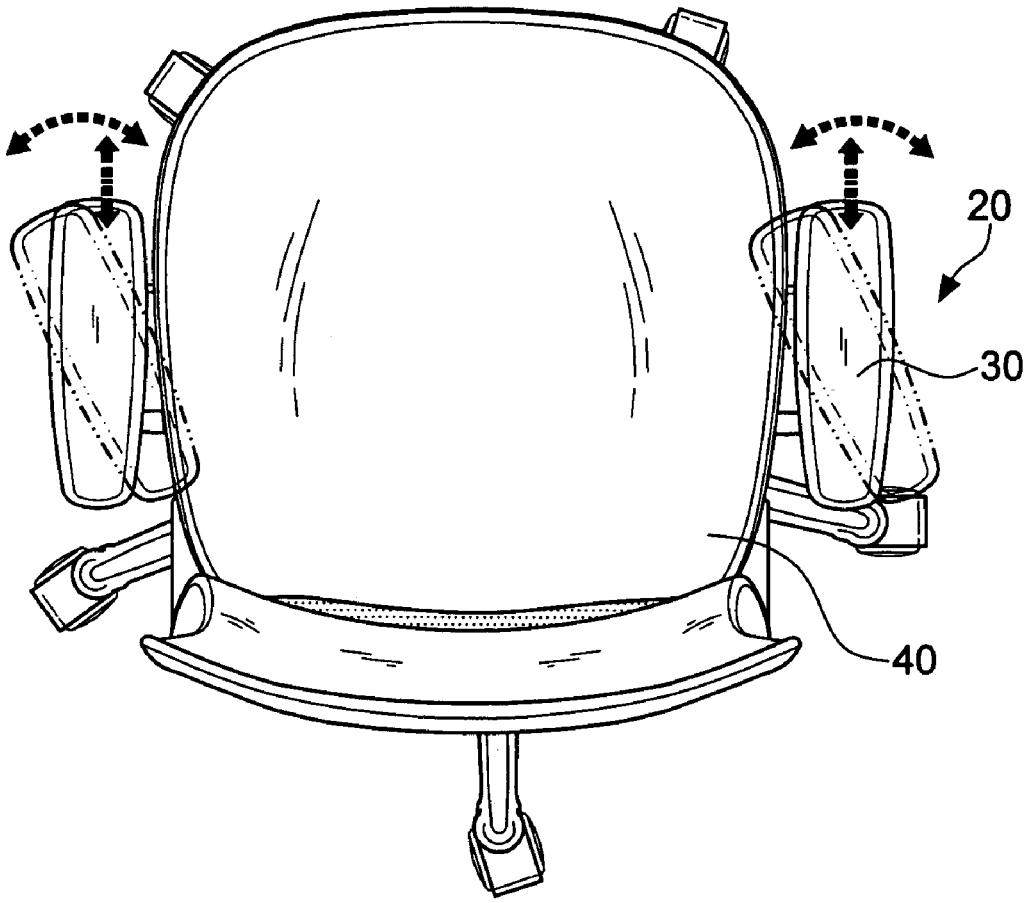
FIG. 8 is top view of the operation of the invention.

As shown in FIG. 8, the positioning angle as well as the front and rear location of the armrest body 30 of the invention are adjustable in addition to the height adjustment thereof. Accordingly, a three-dimensional adjustment is guaranteed.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An apparatus for adjusting an armrest of an office chair, comprising:

a) a supporting body extending in a longitudinal direction with a bottom end attached to one side of a seat body of the office chair, a receiving cavity being defined by a front side of an upper portion of the supporting body, a plurality of notches being continuously arranged and vertically formed in a front wall of the supporting body;

b) a hollow socket mounted on the supporting body and liftable thereon, a flange being formed at a rim of an upward directed opening of the hollow socket, a through hole being directed forward and formed at a bottom of the flange;

c) a locking shank having a pivot pin disposed at a top thereof and pivotally received in the hollow socket at a location corresponding to the receiving cavity of the supporting body as well as a protrusion at a bottom thereof for fitting into one of the notches, a spring being interposed between a front side of the locking shank and a wall of the hollow socket for providing the locking shank with an elastic pushing force directed toward the notches, a holding portion passing through the through hole of the hollow socket from the pivot pin of the locking shank;

d) a retaining plate locked on the flange of the hollow socket, a positioning portion being positioned at a center of the retaining plate; and e) an armrest body transversely disposed at a top of the hollow socket and movably connected to the hollow socket, the armrest body including:

a housing having a cavity formed in a top portion thereof, a bottom plate having a transverse groove at a center thereof for receiving the positioning portion of the retaining plate, two parallel clamping pieces being disposed on the bottom plate within the housing, a plurality of longitudinal ribs being formed on opposite sides of an inner wall of the clamping pieces;

a base being interposed between the two clamping pieces of the housing, a groove and a through hole being formed at a top of the base, a plurality of transverse ribs being provided on a top surface of the groove, an arched projection being positioned at both external sides of the base at a location corresponding to the longitudinal ribs of the two clamping pieces;

a compression piece positioned within the groove of the base, a connection port being formed at a center of the compression piece and passing through the through hole of the base for mounting on the positioning portion of the retaining plate, the compression piece further includes a screw for positioning, an engaging element being respectively received in a notch at a bottom of front and rear ends of the compression piece;

an upper cover retained at a top of the housing; and a top portion being positioned on a surface of the upper cover.

2. The apparatus for adjusting an armrest of an office chair as recited in claim 1, wherein at least one C-shaped rubber ring is positioned at an outer rim of the supporting body.

3. The apparatus for adjusting an armrest of an office chair as recited in claim 1, wherein a control lever is sheathed on the holding portion of the locking shank.

* * * * *